United States Patent [19]

Stich

[11] 4,364,295

[45] Dec. 21, 1982

[54] MUSICAL INSTRUMENT SOUND PICKUP AND METHOD OF ASSEMBLY THEREOF

[76] Inventor: Willi L. Stich, c/o Lawrence Sound Research #1 Industrial Dr., Mt. Juliet, Tenn. 37122

[21] Appl. No.: 239,242

[22] Filed: Mar. 2, 1981

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS 3,902,394 9/1975 Stich ..... 84/1.15

4,220,069 9/1980 Fender ..... 84/1.15

*Primary Examiner*—Stanley J. Witkowski

*Attorney, Agent, or Firm*—Nathaniel A. Humphries

[57] ABSTRACT

A sound pickup for a stringed musical instrument has a hollow open-topped housing with a base plate matingly fitting in the housing; the housing is formed of ABS plastic coated with copper nickel-chrome layers. The base plate is formed of ABS with its outer surface being nickel plated; two parallel slots in the base plate frictionally receive lower edges of parallel elongated coil core blades. An elongated magnet is positioned between the core blades and first and second coil assemblies including elongated slotted plastic bobbins are fitted over the core blades to overlie the magnet with lugs on the bobbins facing opposite ends of the magnet to hold it in position. A cable is connected to the coil members and extended outwardly through the housing with the base plate, coil and blade assembly being positioned in the housing and filled with potting material so that the upper ends of the bobbins and blade members extend outwardly above the housing with the remaining components being held by the potting material upon solidification and additional retention being provided by screw members extending through the bottom of the housing into the base plate.

19 Claims, 7 Drawing Figures

Fig-5
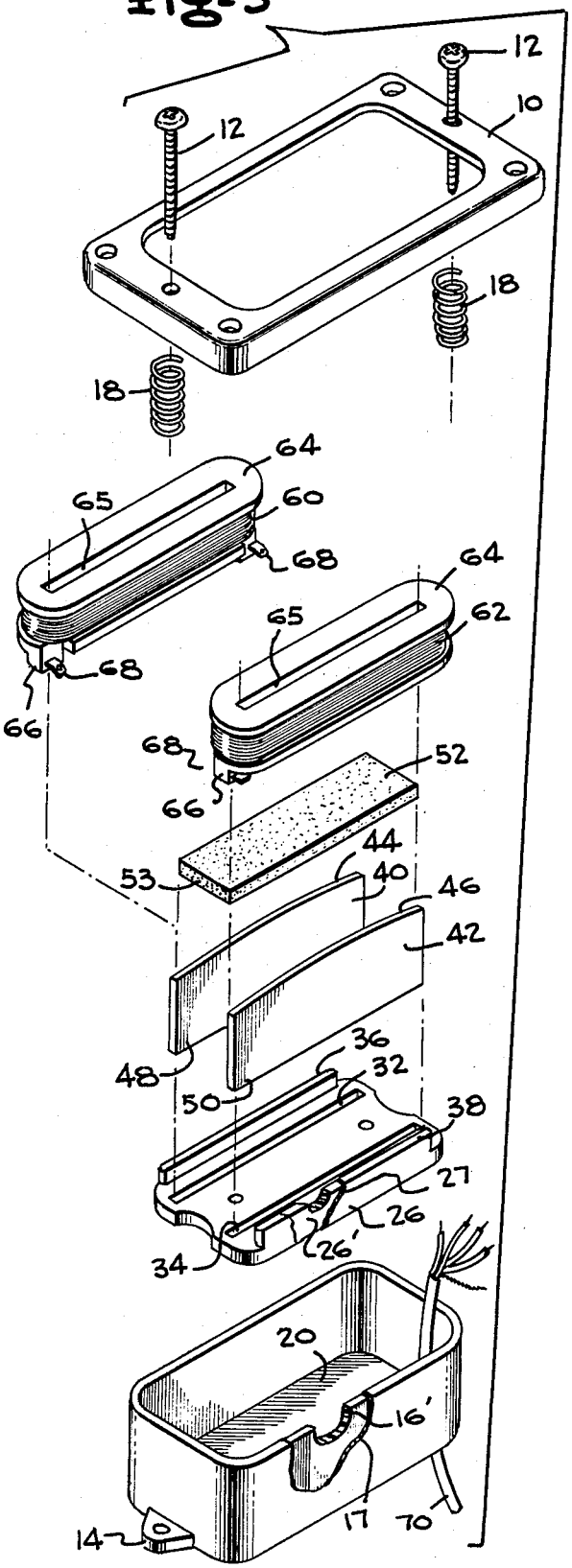
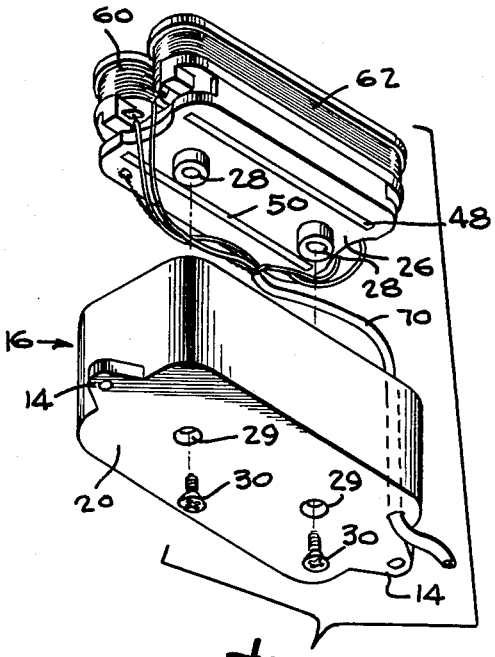
Fig-6
Fig-7
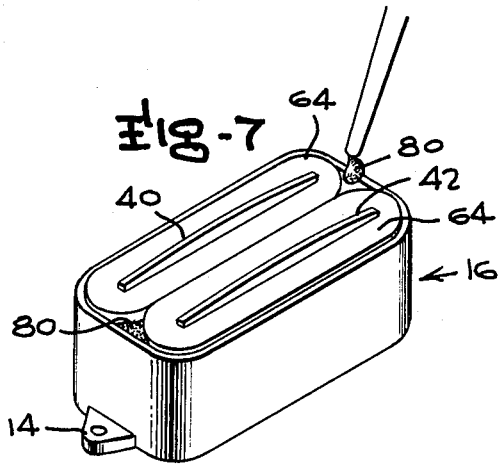

MUSICAL INSTRUMENT SOUND PICKUP AND METHOD OF ASSEMBLY THEREOF

BACKGROUND OF THE INVENTION

The present invention is in the field of mechanical-electrical transducers and is specifically directed to a sound pickup for a stringed musical instrument such as a guitar for providing electrical signals to conventional amplifying equipment.

Sound pickup devices employing electro-magnetic coil means responsive to the movement of the strings of a guitar or the like for providing an output signal have been in use for a substantial number of years. Examples of sound pickup devices are found in U.S. Pat Nos. 3,711,619 and 3,916,751. A substantial problem encountered with sound pickups of this general type has been that many of such pickups have been overly susceptible to hum created by external equipment such as fluorescent lights, transformers and the like. Much effort has been directed toward the elimination of hum so as to provide for an improvement in the overall performance of devices of this type. Also, sound pickups for stringed instruments are sometimes subjected to rough handling and it is therefore desirable that they be capable of withstanding such handling while also providing a high quality signal output. The foregoing problem has resulted in sound pickups which are hand-assembled and include high quality threaded screw type connections for maintaining the components in a desired position; unfortunately, the labor and manufacturing expenses resultant from the employment of screw type connectors and the like is substantial.

Therefore, it is a primary object of the present invention to provide a new and improved sound pickup for a stringed instrument.

Yet another object of the present invention is the provision of a new and improved sound pickup for a stringed instrument which is easy to assemble so as to minimize labor expenses.

Yet another object of the present invention is the provision of a new and improved sound pickup which can withstand rough handling without damage or reduction in the quality of its output signal.

SUMMARY OF THE INVENTION

Achievement of the foregoing objects is enabled by the preferred embodiment of the invention and the preferred method of assembly thereof in which a hollow box-like housing having an open top and formed of ABS plastic having an electro-deposited coating of copper-nickel-chrome layers receives and holds the other components of the assembly. A base plate also formed of ABS plastic and having a coating of nickel which is electro-deposited is fittable inside the hollow housing to rest on the lower surface thereof with the base plate including a pair of parallel plate receiving slots extending longitudinally along its length. Assembly of the pickup begins with the positioning of first and second elongated coil plates formed of stainless transformer steel in the two elongated slots of the base plate. The coil plates are dimensioned so as to be matingly and snugly received along one edge in the slots in the base plate for frictional retention therein. The upper or opposite edge of the coil plates is bowed upwardly slightly. An elongated magnet is then positioned between the coil core blades to rest on the upper surface of the base plate. First and second elongated coil assemblies are then positioned respectively over the first and second coil core blades so as to rest on the upper surface of the magnet with each of the coil assemblies including a plastic bobbin having an elongated slot matingly fittable over one of the coil core blades with the bobbin also having retention lug means at each end extending downwardly in facing alignment with the ends of the magnets so as to maintain the magnet in position on the upper surface of the base plate between the coil core blades and beneath the coils. The base plate and associated magnet, coil blades and coil members are positioned in the housing with a shielded cable connected to the coil members being passed outwardly through an opening in the bottom of the housing. Screw members are positioned in apertures in the bottom of the housing to engage threaded sockets in the base plate to hold the base plate in fixed position in contact with the hollow housing. The hollow housing is then filled with epoxy resin potting compound which is permitted to harden to complete the fabrication procedure. The potting compound completely fills the housing so that the only elements extending above the potting compound consist of the upper portions of the plastic bobbin members and the upwardly bowed edge of the two coil core blades. The resultant assembly has extremely high resistance to outside signals so as to minimize hum and is also extremely rugged and capable of resisting damage from rough handling. Moreover, the resultant device is also easily fabricated by non-skilled labor so as to reduce its overall cost.

A better understanding of the preferred embodiment and the preferred method of fabricating same will be achieved with the following detailed description as considered in conjunction with the appended drawings in which like reference numerals are used for the same parts as illustrated in the different figures.

BRIEF DESCRIPTION OF THE DRAWING

FIG. 5 is an exploded perspective view of the preferred embodiment;

FIG. 6 is an exploded perspective view of the partially assembled preferred embodiment; and FIG. 7 is a perspective view of the preferred embodiment illustrating the final step in the fabrication of same.

DESCRIPTION OF THE PREFERRED EMBODIMENT

Figure 1:
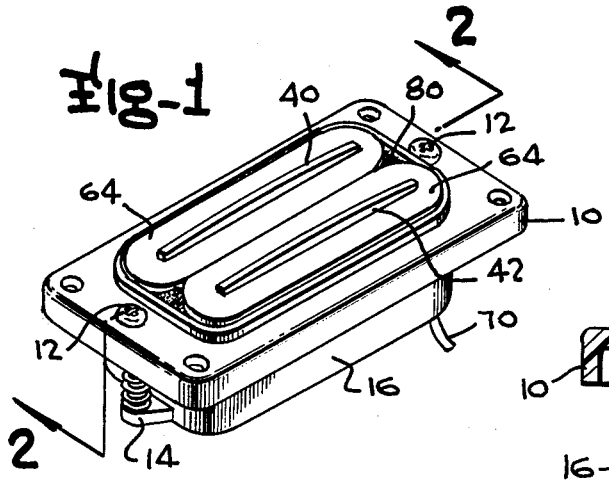
FIG. 1 is a perspective view of the preferred embodiment.
Figure 2:
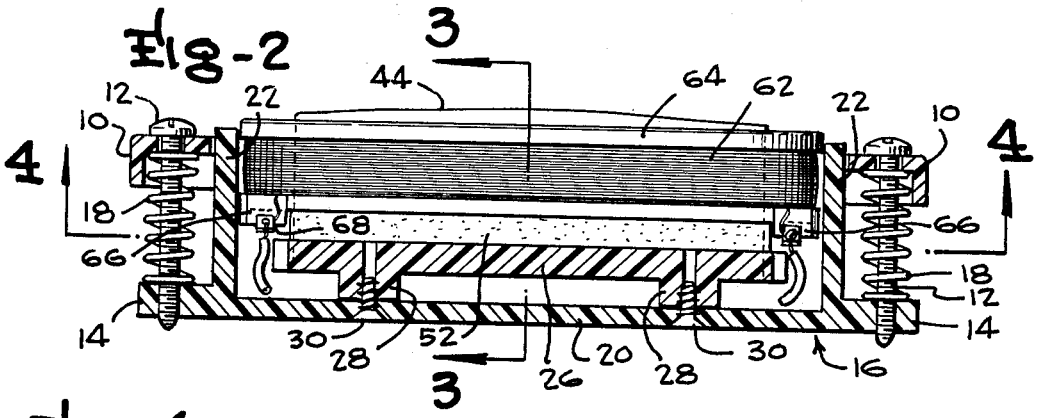
FIG. 2 is a sectional view taken along lines 2—2 of FIG. 1.
Figure 4:
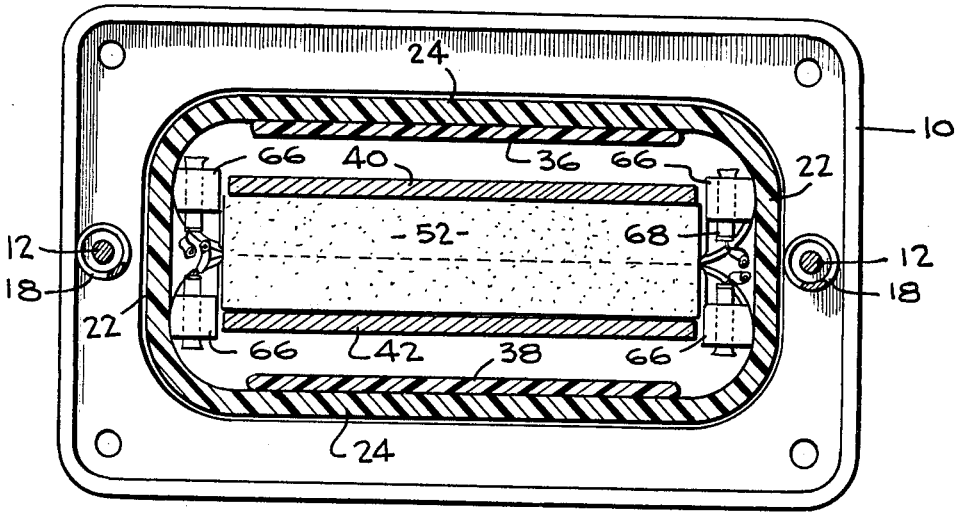
FIG. 4 is a sectional view taken along lines 4—4 of FIG. 2.

FIG. 1 is the drawings illustrates the preferred embodiment of the invention which is shown mounted in a conventional mounting ring or frame 10 formed of molded plastic with the sound pickup components being supported from the mounting frame 10 by threaded screw members 12 extending downwardly through openings in the frame 10 and threadably received in end lugs 14 on opposite ends of a hollow open-topped housing 16 with compression springs 18 urging the assembly downwardly as viewed in FIG. 2 with the downward movement being limited by the head screw members 12 as shown. This type of mounting of the pickup is conventional and forms no part of the present invention.

Hollow housing 16 is formed of EP grade ABS plastic core 16' and has its entire surface coated with a layer 17 of metal consisting of thin electro-deposited layers of copper-nickel-chrome deposited in that order with the chrome being the outer coating. The thickness of the metal coating 17 is exaggerated in FIG. 5. The components of the open-topped housing 16 include a bottom bed plate 20, end walls 22 and side walls 24. A base plate 26 formed of EP grade ABS plastic 26' and coated with electro-deposited layer 27 of nickel is positioned inside the open-topped housing 16. Base plate 26 additionally includes downwardly extending internally threaded lugs 28 which receive threaded screws 30 extending through openings 29 provided in the bottom bed plate 20 as best shown in FIG. 2. Additionally, first and second parallel slots 32 and 34 extend all the way through the base plate 26 with side flanges 36 and 38 defining the side edges of base plate 26 as best shown in FIG. 5.

First and second elongated coil core blades 40 and 42 respectively have upwardly bowed upper surfaces 44 and 46 and lower edges 48 and 50 which are frictionally matingly fitted in the slots 32 and 34 respectively of the base plate 26. The coil core blades 40 and 42 are formed of stainless transformer steel.

An elongated alnico magnet 52, which is preferable formed of cast magnetic material, is positioned on the upper surface of base plate 26 between slots 32 and 34 and the coil core blades 40 and 42 with elongated coil assemblies 60 and 62 being positioned over the first and second coil core blades 40 and 42 respectively so as to closely overlie the magnet 52. The elongated coil core assemblies 60 and 62 each comprise an elongated bobbin 64 having downwardly extending end lugs 66 from which electrical connectors 68 connected to the ends of the wire coiled around the bobbins extend. It should be noted that the end lugs 66 extend downwardly a sufficient distance as to be in horizontal alignment with a portion of the end surfaces 53 of the magnet 52 so as to preclude axial movement of the magnet during the assembly of the device as will be discussed hereinafter. A shielded cable 70 has conductors connected to the connector members 68 and has its outer shielding surface soldered to the base plate 26. The opposite end of the cable 70 extends outwardly through an opening in the bottom bed plate 20 of the housing 16.

Figure 3:
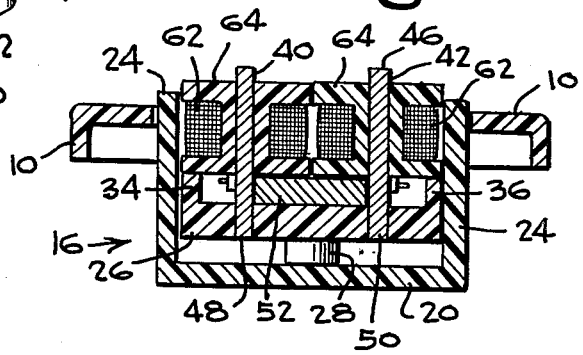
FIG. 3 is a sectional view taken along lines 3—3 of FIG. 2.

The unique method of assembly of the device will now be discussed with primary attention being invited to FIG. 5. The assembly begins with all of the components being disconnected as shown in FIG. 5 with the initial stage in the assembly consisting of the positioning of the lower edges 48 and 50 of the blades 40 and 42 in the slots 32 and 34 with the lower edges of the blades being coextensive with the lower surface of the base plate 26 as shown in FIG. 3. Magnet 52 is in position on the upper surface of the base plate 26 between the blades 40 and 42. Bobbins 64 are then positioned so that their slots 65 slide down over the blades 40 and 42 until they reach the position illustrated in FIG. 3 in which the lower surfaces of the bobbins engage the upper edges of the side flanges 36 and 38. Cable 70 has its conductors connected to the connector terminal 68 either previous to or after positioning of the bobbins on the blades 40 and 42 with the metal shielding of the cable 70 being soldered to the base plate 26 and the opposite end of the cable being passed outwardly through the opening in the bottom bed plate 20 of housing 16. Screws 30 are extended through the openings 29 into the lugs 28 and serve to snugly pull the base plate downwardly into contact with the upper metal coated surface of the bottom bed plate 20. The snug frictional engagement of the blades 40 and 42 with the bobbins 64 and with the slots 32 and 34 serves to maintain all of the parts in position with the lugs 66 on the ends of the bobbins precluding axial movement of the magnet 52. The entire assembly on the base plate 26 is as shown in FIG. 6 and is then moved downwardly into the open-topped housing 16 to the position illustrated in FIG. 3. Liquid epoxy resin potting compound 80 is poured down into the housing 16 to substantially fill same so as to fully enclose the coils, blades, magnet and base plate members to retain same in position in the housing. Also, the epoxy resin upon curing provides a substantial strength for the overall assembly so as to make it resistant to damage from rough handling. The upper bowed edges 44 and 46 and the upper portions of the bobbins 64 extend above the epoxy level as shown in FIG. 7. It should be noted that the epoxy potting material 80 is not illustrated in any other drawing figures with the exception of FIG. 1 since its inclusion would serve to obscure the other components of the preferred embodiment.

Thus, it will be seen that the unique method of assembly is easily performed with a minimum of manual dexterity so as to permit unskilled labor to assemble the device. Nevertheless, the parts are assembled with accuracy so that the resultant product is of high durability and provides optimal sound reproduction. Moreover, the device has been found to be extremely resistant to outside interference which would normally be expected to create hum in the output signal.

Numerous modifications of the preferred embodiment of the invention will undoubtedly occur to those of skill in the art and it should therefore be understood that the spirit and scope of the invention is to be interpreted solely by the scope of coverage provided by the appended claims.

I claim:

1. A sound pickup for a stringed musical instrument comprising:

a hollow housing having a top opening and a bottom bed plate;

a base plate positioned in said hollow housing on said bed plate and including first and second parallel elongated apertures;

first and second elongated coil core blades respectively having one edge matingly and snugly fitted into said first and second parallel elongated apertures for retention therein and having a second opposite edge positioned outwardly of said top opening of said hollow housing;

elongated magnet means positioned on said base plate between said first and second elongated coil core blades;

first and second elongated coil assemblies respectively matingly fitted over said first and second elongated coil core blades with each coil assembly partially overlying said elongated magnet means;

holding means for retaining said base plate in fixed position in said hollow housing; and conductor means extending from said elongated coil assemblies through said housing.

2. The sound pickup of claim 1 wherein the second edge of said elongated coil core blades is bowed outwardly.

3. The sound pickup of claim 2 wherein said elongated coil core blades are formed of stainless steel.

4. The sound pickup of claim 2 wherein said base plate and hollow housing are formed of metal coated plastic.

5. The sound pickup of claim 2 wherein said holding means includes solidified potting material filling said housing.

6. The sound pickup of claim 2 wherein said core assemblies each include an elongated plastic bobbin having an elongated central slot matingly fitted over one of said elongated coil core blades.

7. The sound pickup of claim 1 wherein said elongated coil core blades are formed of stainless steel and the base plate is metal coated plastic.

8. Th sound pickup of claim 7 wherein said housing means includes threaded screw members extending through said bottom bed plate and threadably connected to said base plate and solidified potting material filling said housing.

9. The sound pickup of claim 8 wherein said core assemblies each include an elongated plastic bobbin having an elongated central slot matingly fitted over one of said elongated coil core blades.

10. The sound pickup of claim 9 wherein the second edge of said elongated coil core blades is bowed outwardly.

11. The sound pickup of claim 9 wherein said base plate and housing are formed of metal coated plastic.

12. The sound pickup of claim 9 wherein said base plate and hollow housing are formed of ABS plastic having a thin surface coating of metal.

13. The sound pickup of claim 12 wherein said elongated coil core blades are formed of transformer type stainless steel alloy.

14. The sound pickup of claim 1 wherein said core assemblies each include an elongated plastic bobbin having an elongated central slot matingly fitted over one of said elongated coil core blades with retainer lugs on each end of each bobbin overlying opposite ends of said elongated magnet means.

15. The sound pickup of claim 14 wherein said base plate and hollow housing are formed of ABS plastic coated with a thin metal coating.

16. The sound pickup of claim 15 wherein said elongated coil core blades are formed of stainless steel.

17. The sound pickup of claim 16 wherein said holding means includes solidified potting material filling said housing.

18. The sound pickup of claim 16 wherein said holding means includes threaded screw members extending through said bottom bed plate and threadably connected to said base plate and solidified potting material filling said housing.

19. The sound pickup of claim 18 wherein the metal coating on the hollow housing consists of layers of copper, nickel and chrome, the metal coating on the base plate is nickel and the potting material is an epoxy resin.

* * * * *